United States Patent [19]

Monroe

[11] 4,055,113

[45] Oct. 25, 1977

[54] VENTILATOR APPARATUS

[75] Inventor: Thomas D. Monroe, Memphis, Tenn.

[73] Assignee: Robbins & Myers, Inc., Springfield, Ohio

[21] Appl. No.: 684,147

[22] Filed: May 7, 1976

[51] Int. Cl.[2] ..... F24F 7/02; F24F 13/10

[52] U.S. Cl. ..... 98/43 C; 98/116; 310/209; 415/131; 417/424

[58] Field of Search ..... 98/43, 116; 415/131, 415/148; 310/191, 209; 417/424

[56] References Cited

U.S. PATENT DOCUMENTS

| | | | |
|---|---|---|---|
| 3,073,248 | 1/1963 | Bartels | 415/131 |
| 3,162,128 | 12/1964 | Horlen | 415/131 |
| 3,184,933 | 5/1965 | Gaugler | 310/209 X |
| 3,329,095 | 7/1967 | Bartels | 415/131 X |
| 3,401,624 | 9/1968 | Mohrman | 98/116 |
| 3,472,150 | 10/1969 | Strawsine | 98/43 R X |
| 3,942,422 | 3/1976 | Kawai et al. | 98/116 |

*Primary Examiner*—William E. Wayner
*Assistant Examiner*—William E. Tapolcai, Jr.
*Attorney, Agent, or Firm*—Jacox & Meckstroth

[57] ABSTRACT

Ventilator apparatus which includes rotary impeller or fan structure and an electric motor for rotation thereof. A shaft joins the rotor of the electric motor to the impeller or fan structure for rotation thereof. The rotor of the electric motor, in addition to being rotatable, is axially movable upon energization thereof. A shroud encompasses the impeller or fan structure. A closure member attached to the shaft is adapted to be closely positioned with respect to the end of the shroud to substantially close the shroud when the apparatus is not in ventilating operation. When the rotor of the electric motor is energized for operation of the impeller, the rotor, in addition to commencing rotation, moves axially and moves the closure member axially to spaced relationship from the shroud, to provide an opening between the shroud and the closure member for flow of air between the shroud and the closure member. The ventilator apparatus is particularly adapted to exhaust air from an attic region or the like of a building. However, the apparatus is also adapted for use in numerous other environments.

12 Claims, 4 Drawing Figures

VENTILATOR APPARATUS

BACKGROUND OF THE INVENTION

Numerous types of ventilator apparatus have been constructed for exhausting air from an attic region or the like. One type of ventilator apparatus is that which is part of a duct or shroud which forms an opening in a roof or gable to exhaust air therefrom. A fan or impeller is rotatable within the shroud to force movement of air therethrough. A cover member is attached to the shroud or to the building in spaced relationship from the shroud to protect the shroud and to provide a passage between the shroud and the cover member for flow of air therebetween. The existence of the fixed spaced-relationship between the shroud and the cover member is objectionable, due to the fact that insects, dirt, and other material can enter the upper portion of the building through the shroud when the apparatus is not in operation.

An object of this invention is to provide ventilator apparatus which is particularly adapted as air exhaust means for the upper region of a building, in which a closure member normally substantially closes an opening leading from the upper region of the building to the outside when the ventilator apparatus is not in operation, and in which the closure member is automatically moved to open position when the ventilator apparatus operates.

Another object of the invention is to provide such ventilator apparatus in which operation of the electric motor which rotates a fan or impeller of the ventilator apparatus also operates the closure member.

Other objects and advantages of this invention reside in the construction of parts, the combination thereof, the method of manufacture, and the mode of operation, as will become more apparent from the following description.

BRIEF DESCRIPTION OF THE VIEWS OF THE DRAWINGS

FIG. 3 shows the elements of the apparatus when the apparatus is not in ventilating operation.

DETAILED DESCRIPTION OF THE PREFERRED EMBODIMENT

Figure 1:
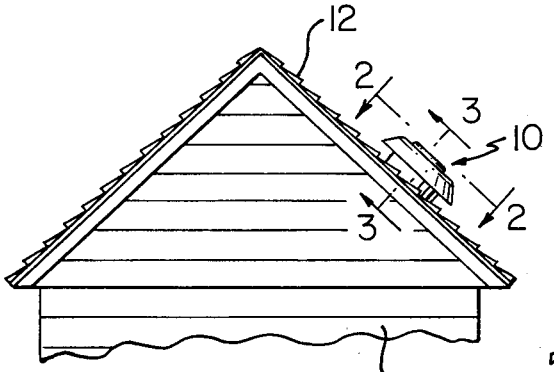
FIG. 1 is a fragmentary elevational view illustrating ventilator apparatus of this invention mounted on the roof of a building for exhausting air from the upper interior region of the building.

As illustrated in FIG. 1, ventilator apparatus 10 of this invention is adapted to be mounted on a roof portion 12 of a building 14 or in any other suitable portion of the building 14. Ordinarily the ventilator apparatus is employed to exhaust air from an upper region of a building, such as the building 14, and is therefore usually located on a gable or wall or roof of a building, such as the building 14.

The ventilator apparatus 10 of this invention comprises an annular shroud or air duct 18, having an annular base 20 attached to the roof 12. The shroud 18 is shown as having a curved upper portion 19. The roof 12 has an opening 22 therein which is encompassed by the base 20 of the annular shroud 18.

An elongate support bar 26 extends across the shroud 18 therewithin and has an annular bracket 30 which firmly encompasses and supports an electric motor housing 32. Within the motor housing 32 is a magnetizable stator 34 having a winding 36. Attached to the lower portion of the housing 32 is a bearing 40, within which is a portion of a rotatable shaft 44. Within the stator 34 is a rotor 48 which is attached to the shaft 44 for rotation thereof. Encompassing the shaft 44, below the rotor 48, and secured to the shaft 44, is a spacer bearing 52.

Figure 2:
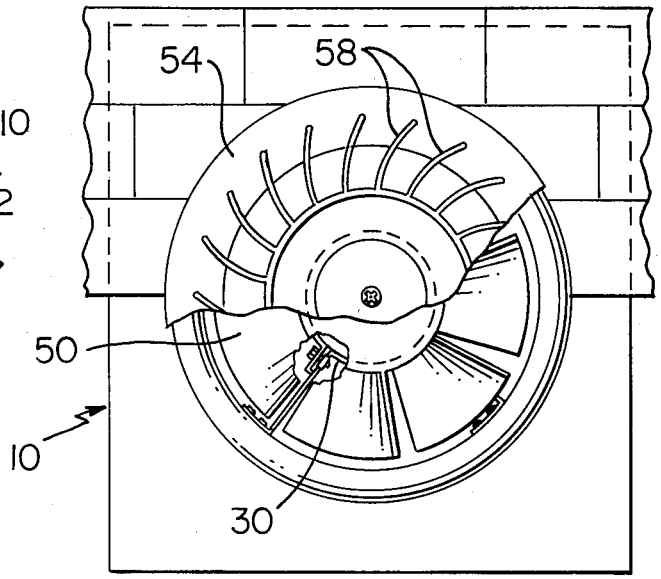
FIG. 2 is an enlarged elevational view taken substantially on line 2—2 of FIG. 1.

The shaft 44 extends upwardly from the rotor 48 and through a bearing 49, and from the housing 32. The upper portion of the shaft 44 has attached thereto for rotation therewith an air impeller or fan member 50. Also, attached to the shaft 44 is a closure member 54, which is preferably, but not necessarily, rotatable with the shaft 44. The upper surface of the closure member 54, as shown in FIGS. 2, 3, and 4, is provided with an annular arrangement of curved ribs or blades 58, each of which is somewhat radial.

Figure 3:
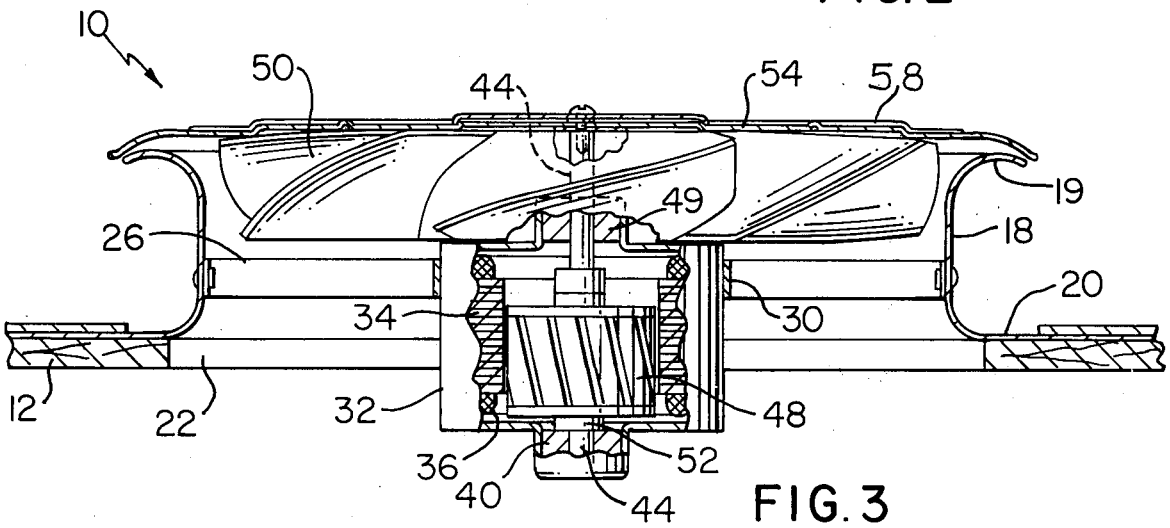
FIG. 3 is an enlarged sectional view, drawn on a larger scale than FIG. 2, and taken substantially on line 3—3 of FIG. 1.
Figure 4:
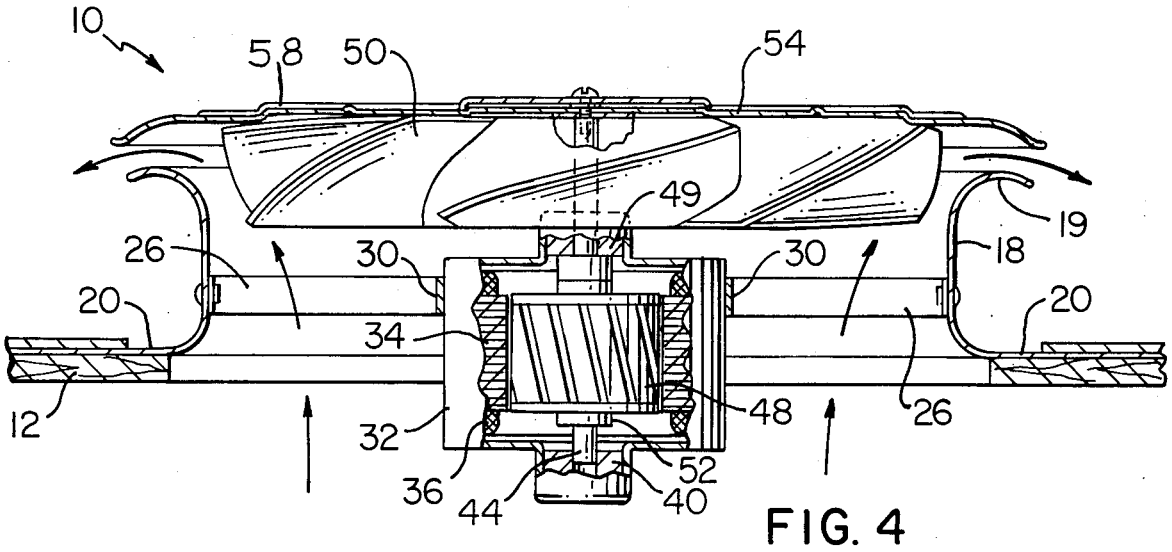
FIG. 4 is an enlarged sectional view, similar to FIG. 3, showing the elements of the ventilator apparatus during ventilating operation thereof.

When the electric motor stator 34 is not energized, the rotor 48 is not in rotation and is positioned as shown in FIG. 3. The bearing spacer 52 which encompasses the shaft 44 is resting upon the bearing 40, and the rotor 48 is out of electro-magnetic alignment with the stator 34. The shaft 44 is thus in its lowermost position and the closure member 54 is very close to or in substantial engagement with the curved upper portion 19 of the shroud 18, closing communication between the inner portion of the building 14 and the exterior thereof. Thus, dust, insects and other foreign material and the like may be prevented from entering the building 14 through the shroud 18.

When the electric motor stator winding 36 is energized, the stator 34 and the rotor 48 are magnetically energized. When this occurs, the rotor 48 is caused to commence rotation and simultaneously is axially moved to a position electro-magnetically aligned with the stator 34, as illustrated in FIG. 4. Thus, as the rotor 48 begins rotation, the shaft 44 commences rotation, and is moved axially. Simultaneously, the impeller or fan member 50 commences rotation and is moved axially to the position thereof illustrated in FIG. 4. Also, with such axial movement of the shaft 44, the closure member 54 is moved axially from the closed position thereof shown in FIG. 3 to the open position thereof shown in FIG. 4. The closure member 54 commences rotation with axial movement thereof, and with rotation thereof the blades 58 on the upper surface create air movement which enhances flow of air from the shroud 18.

Thus, a passage is provided between the curved upper portion 19 of the shroud 18 and the closure member 54 for flow of air from the shroud 18, as air is drawn by the rotating impeller 50 from the inner portion of the building 14.

When the electric motor winding 36 is deenergized, the rotor 48 is magnetically deenergized and moves axially to a position out of electro-magnetic alignment with the stator and ceases to rotate. Thus, the rotor 48 again resumes the position thereof shown in FIG. 3. Thus, the closure member 54 and the fan member 50 return to the position thereof shown in FIG. 3. Thus, the closure member 54 again is positioned in closing relationship to the shroud 18, and the fan member 50 is at rest within the shroud 18. It is to be understood that for proper operation of the ventilator apparatus of this invention, the closure member 54 does not need to be positioned upwardly with respect to the electric motor housing 32, and there may be any desired relative elevational position of the electric motor housing 32 with respect to the closure member 54. It is also to be understood that, upon deenergization of the stator 34 and rotor 48, means other than gravity may be employed to return the rotor 48, the shaft 44, the impeller 50, and the closure member 54 to the normal inactive positions thereof in which the rotor 48 is out of electro-magnetic alignment with respect to the stator.

Although the preferred embodiment of the ventilating apparatus of this invention has been described, it will be understood that within the purview of this invention various changes may be made in the form, details, proportion and arrangement of parts, the combination thereof, and the mode of operation, which generally stated consist in ventilating apparatus within the scope of the appended claims.

The invention having thus been described, the following is claimed:

1. Ventilator apparatus of the type provided with an annular shroud, a fan member encompassed by the shroud, the improvement comprising:

an electric motor coaxial with the fan member, the electric motor including a stator and a rotor, the rotor being rotatably and axially movable within the stator by magnetic forces created within the stator and rotor, a shaft attached to the rotor and rotatably and axially movable therewith, the fan member being attached to the shaft for rotative and axial movement therewith, a closure member attached to the shaft for axial movement therewith, the closure member being in a normal inactive position in substantial closing relationship to the shroud, the rotor, when magnetically energized, moving rotatively and axially with respect to the stator, thus rotatively and axially moving the shaft and the fan member and moving the closure member axially, positioning the closure member in spaced relationship from the shroud for movement of air between the shroud and the closure member during rotation of the fan member.

2. The ventilator apparatus of claim 1 in which the closure member is attached to the shaft for rotative movement therewith, as well as for axial movement therewith.

3. In ventilator apparatus adapted for mounting on a building structure to exhaust air from the building structure, and including conduit means defining an air flow passage, an electric motor having a rotor shaft, a rotor supported by the rotor shaft for rotation of the rotor shaft with rotation of said rotor, a blower impeller driven by said rotor shaft and disposed generally within said conduit means, and closure means movable between a closed position and an open position for controlling air flow through said passage, the improvement comprising means supporting said rotor shaft and the rotor for axial movement in response to energization of said electric motor, and means operably connected to said rotor shaft for moving said closure means between said closed and open positions in response to axial movement of said rotor shaft and said rotor.

4. Ventilator apparatus as defined in claim 3 wherein said blower impeller is connected to said rotor shaft for both rotational and axial movement therewith, and said closure means comprise a closure member connected to said rotor shaft for axial movement therewith.

5. Ventilator apparatus as defined in claim 4 wherein said conduit means and said closure member cooperate to define an annular air discharge outlet, and said closure member is effective to close said outlet when said closure member is disposed in said closed position.

6. Ventilator apparatus as defined in claim 4 wherein said conduit means is generally circular in cross-section and includes an outwardly projecting annular flange portion, said closure member includes a peripheral portion cooperating with said flange portion to define an annular air discharge outlet, and said peripheral portion of said closure member is movable axially between said closed position adjacent said annular flange portion of said housing and said open position spaced axially from said annular flange portion of said conduit means.

7. Ventilator apparatus adapted to be attached to the upper portion of a building to exhaust air therefrom through an opening therein comprising: an annular shroud encompassing the opening and having a base portion attached to the building, an electric motor coaxial with the annular shroud, support means attaching the electric motor to the shroud, the electric motor having an electrically energizable stator and a rotor, the rotor being rotatable and axially movable with respect to the stator with electric energization of the stator, a shaft attached to the rotor for rotative and axial movement therewith, a fan member encompassed by the shroud and attached to the shaft for rotative and axial movement therewith, a closure member concentric with the shroud and attached to the shaft for rotative and axial movement therewith, the closure member being movable from a position adjacent the shroud to a position spaced from the shroud with axial movement of the shaft with axial movement of the rotor, rotation of the rotor thus causing rotation of the fan member for forcing movement of air from within the building and outwardly therefrom through the opening therein and through the shroud, the air moving from the shroud between the closure member and the shroud.

8. Ventilator apparatus adapted to be attached to the upper portion of a building to exhaust air therefrom through an opening therein comprising: an annular shroud encompassing the opening and having a base portion attached to the building, an electric motor concentric with the annular shroud, support means attaching the electric motor to the shroud, the electric motor having an electrically energizable stator and a rotor, the rotor being rotatable and axially movable with respect to the stator with electrical energization of the stator, a shaft attached to the rotor for rotative and axial movement therewith, a fan member encompassed by the shroud, means attaching the fan member to the shaft for rotative and axial movement therewith, a closure member concentric with the shroud and attached to the shaft for rotative and axial movement therewith, a plurality of blade members attached to the closure member exterior of the shroud, the closure member being axially movable from a position adjacent the shroud to a position spaced from the shroud with axial movement of the shaft with axial movement of the rotor, rotation of the rotor thus causing rotation of the shaft and the fan member and the closure member and the blade members for movement of air from within the building and outwardly therefrom through the opening therein and through the shroud, the air moving from the shroud between the closure member and the shroud.

9. Ventilator apparatus adapted to be attached to the upper portion of a building to exhaust air therefrom through an opening therein comprising: an annular shroud encompassing the opening and having a base portion attached to the building, an electric motor concentric with the annular shroud, support means attaching the electric motor to the shroud, the electric motor having an electrically energizable stator and a rotor, the rotor being rotatable and axially movable with respect to the stator with electrical energization of the stator, a shaft attached to the rotor for rotative and axial movement therewith, a closure member exterior of the shroud and attached to the shaft for rotative and axial movement therewith, the closure member being axially movable from a position adjacent the shroud to a position spaced from the shroud with axial movement of the shaft with axial movement of the rotor, the closure member having an inner surface and an outer surface, fan means adjacent each surface of the closure member for rotation therewith, the closure member moving axially with axial movement of the rotor, the closure member and the fan means thus rotating with rotation of the rotor for movement of air through the shroud.

10. In ventilator apparatus of the type provided with an annular shroud, a fan encompassed by the shroud, an electric motor connected to the fan for rotation thereof, the combination in which the electric motor includes a stator member and a rotor member which are relatively rotatably and axially movable by electro-magnetic forces created within the stator member and the rotor member, closure means adjacent the shroud, means joining the closure means to one of said members for axial movement of the closure means with axial movement thereof, the closure means being in a normal inactive position in substantial closing relationship to the shroud, the closure means when moved axially being positioned in spaced relationship from the shroud to provide a passage for movement of air between the shroud and the closure means during rotation of the fan.

11. Ventilator apparatus adapted to be attached to the upper portion of a building to exhaust air therefrom through an opening therein comprising: an annular shroud encompassing the opening and having a base portion attached to the building, an electric motor concentric with the annular shroud, support means attaching the electric motor to the shroud, the electric motor having an electrically energizable stator and a rotor, the rotor being rotatably and axially movable with respect to the stator with electrical energization of the stator, air control means including fan means and shroud closure means, means attaching the air control means to the rotor for rotative and axial movement therewith, the air control means being movable from a closed position with respect to the shroud to an open position with respect to the shroud with axial movement of the rotor of the electric motor, the air control means when in the open position rotating with the rotor for movement of air through the shroud and providing an opening between the shroud and the air control means for flow of air from the shroud.

12. Ventilator apparatus of the type provided with annular air duct means, a fan member rotatable within the annular air duct means, electric motor means for operation of the fan member, the improvement comprising: a closure member having a closed position with respect to the air duct means, the closure member having an open position with respect to the air duct means, the electric motor means including a rotor element and a stator element in which there is relative rotative and axial movement between the rotor and the stator upon electrical energization of the stator, means operably connected to one of said elements for moving the closure member from its closed position to its open position with respect to the air duct means with relative axial movement between the rotor and the stator.

* * * * *